United States Patent [19]

Opresko

[11] Patent Number: 4,558,254

[45] Date of Patent: Dec. 10, 1985

[54] CATHODE-RAY TUBE HAVING AN IMPROVED LOW POWER CATHODE ASSEMBLY

[75] Inventor: Stephen T. Opresko, Lancaster, Pa.

[73] Assignee: RCA Corporation, Princeton, N.J.

[21] Appl. No.: 605,243

[22] Filed: Apr. 30, 1984

[51] Int. Cl.[4] ..... H01J 29/46

[52] U.S. Cl. ..... 313/446; 313/270

[58] Field of Search ..... 313/417, 446, 456, 270, 313/409

[56] References Cited

U.S. PATENT DOCUMENTS

| | | | |
|---|---|---|---|
| 3,569,768 | 3/1971 | Benda | 313/270 |
| 3,772,554 | 11/1973 | Hughes | 313/69 C |
| 3,881,124 | 4/1975 | Buescher et al. | 313/446 |
| 3,883,767 | 5/1975 | Buescher et al. | 313/341 |
| 4,071,803 | 1/1978 | Takanashi et al. | 313/409 |
| 4,184,100 | 1/1980 | Takanashi et al. | 313/337 |
| 4,298,818 | 11/1981 | McCandless | 313/417 |
| 4,370,588 | 1/1983 | Takahashi et al. | 313/446 |

OTHER PUBLICATIONS

U.S. patent application, Ser. No. 559,378, filed by S. T. Opresko on 12/8/83, entitled, "Cathode-Ray Tube Having a Low Power Cathode Assembly", RCA 80,078.

*Primary Examiner*—David K. Moore

*Attorney, Agent, or Firm*—Eugene M. Whitacre; Dennis H. Irlbeck; Vincent J. Coughlin, Jr.

[57] ABSTRACT

A cathode-ray tube having an electron gun includes a novel cathode sleeve, a heater filament having a heater body with a pair of heater legs disposed within the sleeve and a pair of heater straps attached to the heater legs. The novel cathode sleeve comprises a generally longitudinally extending first portion having a first diameter which conforms closely to the heater body portion of the heater filament for reducing the power requirement thereof, and a second generally longitudinally extending portion having a diameter greater than the first diameter. The second portion has a segment which coaxially encompasses a section of the first portion of the cathode sleeve. The segment of the second portion is connected to the section of the first portion by a reverse drawn transition region which effectively extends the thermal length of the cathode sleeve to minimize the conduction of heat therealong. A plurality of slots may be formed in the transition region to provide heat dams to further limit the heat conduction along the cathode sleeve. The novel cathode sleeve permits the use of a heater having shortened heater legs which terminate within the larger diameter second portion. The heater legs are attached within the second portion to a pair of heater straps accommodated therein, thereby minimizing thermal losses from the heater legs.

5 Claims, 8 Drawing Figures

CATHODE-RAY TUBE HAVING AN IMPROVED LOW POWER CATHODE ASSEMBLY

BACKGROUND OF THE INVENTION

The invention relates to a cathode-ray tube and, more particularly, to a low power cathode assembly for such a tube in which the thermal losses due to heat conduction along the cathode sleeve as well as radiation and conduction losses from the legs of the cathode heater are reduced.

U.S. Pat. No. 3,772,554, issued to R. H. Hughes on Nov. 13, 1974, discloses a conventional inline electron gun having three cathode assemblies and a plurality of spaced electrodes individually attached to a pair of glass support rods. The beam forming region comprising the cathode assemblies, the control grid (G1) electrode and the screen grid (G2) electrode is shown in FIG. 1. A portion of the main electron lens, including the focusing electrode (G3) is also shown in FIG. 1. The conventional cathode assemblies disclosed in the Hughes patent typically operate at about 1.3 to 1.6 watts of input power per cathode assembly. This level of power consumption causes a great deal of heat to be generated resulting in excessive longitudinal motion between adjacent electrodes in the beam forming region. Typically, the cathode-to-G1 spacing varies as much as about 0.08 mm (3 mils), and changes of about 0.025 mm (1 mil) typically occur between the G1 and G2 electrodes.

U.S. Pat. No. 4,298,818, issued to H. E. McCandless on Nov. 3, 1981, discloses an improved electron gun having a unitized cathode-grid subassembly comprising three cathode support members and two spaced successive electrodes (the G1 and G2 electrodes) individually attached to a single ceramic member, which is the sole supporting interconnection for the elements of the beam forming region. The cathode assemblies described in the McCandless patent are conventional and operate at about 1.3 to 1.6 watts of input power per cathode. Despite the unitized construction disclosed in the McCandless patent, which improves alignment between adjacent electrodes, excessive longitudinal motion occurs between the cathode assemblies and the G1 electrode and between the G1 and G2 electrodes because of the amount of heat produced by the conventional cathode assemblies. The McCandless electron gun structure is shown in FIG. 2.

U.S. Pat. No. 4,370,588, issued to K. Takahashi et al. on Jan. 25, 1983, discloses, in FIG. 3 thereof, a low power cathode assembly of complex construction. In the patented cathode assembly, a first cylindrical reflective member, which has a disklike metal substrate thrusted and fixed in the top opening portion thereof, surrounds the upper portion of a cathode sleeve. The cathode sleeve and the first cylindrical reflective member are fixed to each other by welding or the like. The cathode sleeve is also fixed to a peripheral edge of a second cylindrical reflective member by means of three support straps, which are welded to the bottom end of the cathode sleeve at intervals of 120° so that the cathode sleeve may be coaxial with the second cylindrical reflective member. The exposed exterior surface of the cathode sleeve is blackened to increase radiation therefrom. However, by disposing the first cylindrical reflective member around the top portion of the cathode sleeve, heat from the top portion of the cathode sleeve is reflected by the first cylindrical reflective member to reduce radiation to the outside. The patent discloses that heat radiated from the blackened surface of the cathode sleeve is equivalent to heat radiated from the surface of a non-conductive material. The amount of heat radiation from the blackened surface is substantially uniform for radiation at an angle exceeding 30° to the radiation surface, but decreases drastically below 30°. Thus, by properly locating the first and second cylindrical reflective members, most of the heat radiated from the blackened cathode sleeve is not radiated to the outside, so that a power saving cathode assembly can be obtained. The cathode assembly described in the Takahashi et al. patent requires a minimum of seven parts (not including a cathode heater) which must be welded together. Such a labor intensive structure is costly and complex. The need thus exists for a simple, low cost, low power cathode assembly.

U.S. patent application, Ser. No. 559,370, filed on Dec. 8, 1983, by S. T. Opresko, discloses a low power cathode assembly including a one-piece cathode sleeve closed at one end and having an integral cap. The cathode sleeve has a longitudinally extending first portion with an outside diameter of about 1.47 to about 1.50 mm that conforms closely to the heater for reducing the power requirements thereof. The cathode sleeve includes at least one other longitudinally extending portion which has a diameter greater than the diameter of the first portion. The first portion and the other portion of the cathode sleeve are connected by a transition region inclined at an obtuse angle to the longitudinally extending first portion of the sleeve. A plurality of openings are formed in the transition region of the sleeve to provide a heat dam to restrict the conduction of heat along the sleeve and to limit the radiative heat loss through the openings from the heater legs disposed within the cathode sleeve. The overall length of the cathode sleeve is disclosed to be 8.76 mm so that the legs of the heater must be sufficiently long to extend beyond the open end of the cathode sleeve for electrical connection to the heater straps. It has been found that the total heat loss of the heater legs is about 20 percent of the input power, thereby decreasing the efficiency of the cathode assemblies and raising the minimum power requirements for a three-cathode structure by about 0.50 watts.

SUMMARY OF THE INVENTION

A cathode-ray tube having an electron gun includes a novel cathode sleeve and a heater filament having a heater body portion with a pair of heater legs extending therefrom disposed within the sleeve. The heater legs are attached to a pair of heater straps. The cathode sleeve has oppositely disposed ends, one end being open and the other end being closed. The closed end includes an integral cap having an electron emitting coating thereon. The novel cathode sleeve comprises a generally longitudinally extending first portion having a first diameter conforming closely to the heater body portion of the heater filament for reducing the power requirement thereof, and a second generally longitudinally extending portion having a diameter greater than the first diameter. The second portion has a segment which coaxially encompasses a section of the first portion of the sleeve. The first portion and the second portion of the cathode sleeve are connected by transition means. The transition means effectively extends the thermal length of the sleeve to minimize heat conduction therealong. Means are also provided for minimizing the thermal losses from the heater legs.

DETAILED DESCRIPTION OF THE PREFERRED EMBODIMENTS

Figure 1:
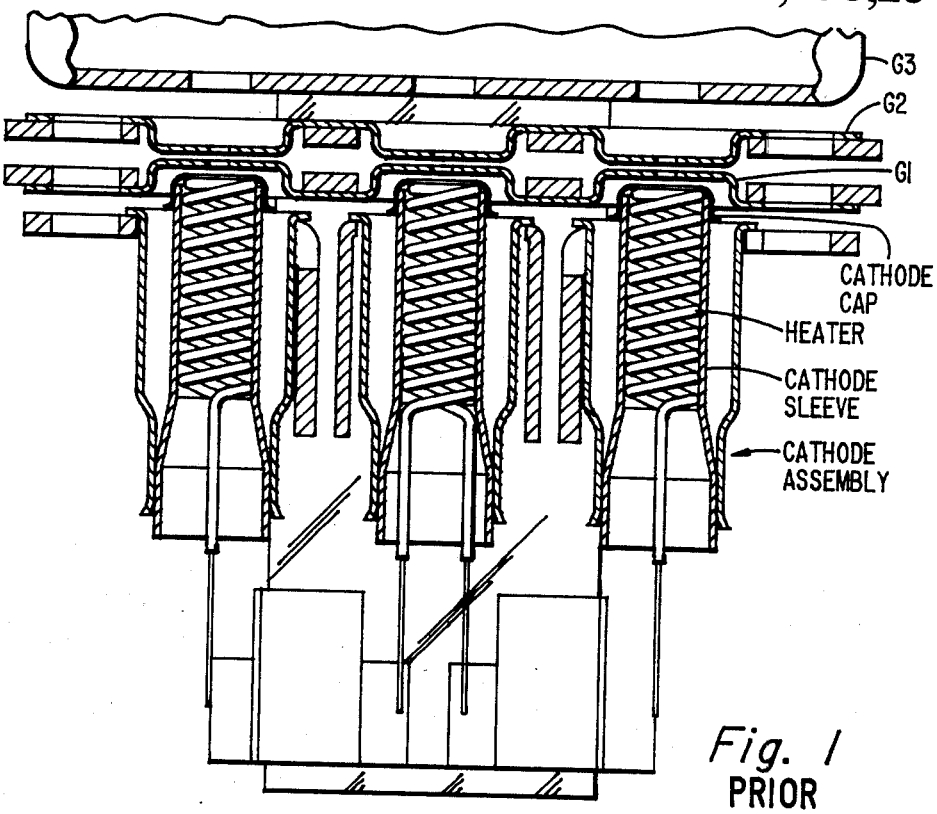
Fig. 1 PRIOR ART
FIG. 1 is a section view of a portion of an inline electron gun assembly having conventional cathode assemblies.
Figure 2:
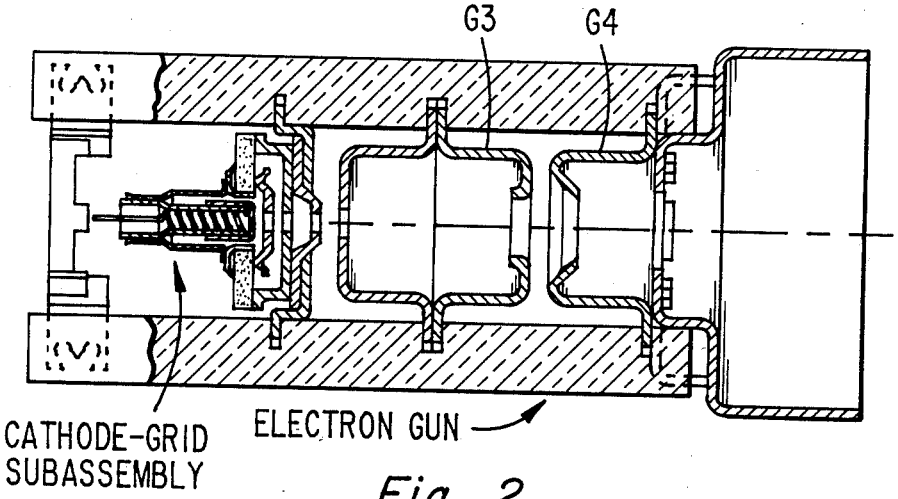
Fig. 2 PRIOR ART
FIG. 2 is an axial section view of an inline electron gun assembly having a unitized cathode-grid subassembly with conventional cathode assemblies.
Figure 3:
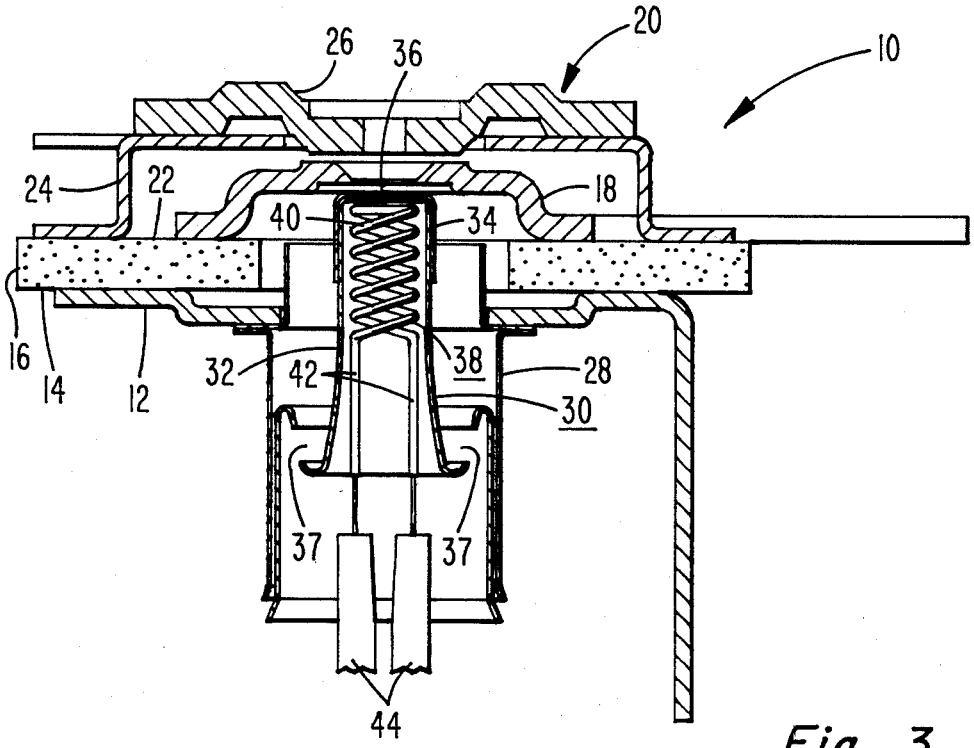
FIG. 3 is an enlarged axial section view of a color picture tube electron gun incorporating the present invention.

A cathode-grid subassembly 10 for an inline electron gun of a cathode-ray tube is shown in axial section in FIG. 3. The cathode-grid subassembly 10 comprises three identical cathode support members 12 (only one of which is shown) secured to a first surface 14 of a ceramic support member 16. A control grid (G1) electrode 18 and a screen grid (G2) electrode assembly 20 are secured to a second surface 22 of the ceramic support member 16. The screen grid (G2) electrode assembly 20 comprises a G2 support plate 24 and a G2 insert 26. Three cathode eyelets 28 (only one of which is shown) are secured to the cathode support members 12. A novel cathode assembly 30 is secured within each of the eyelets 28.

The cathode assembly 30 comprises a novel tubular cathode sleeve 32 closed at the forward end and having an integral cap 34 with an end coating 36 of an electron emitting material thereon. The cap 34 extends along a portion of the sleeve 32. A plurality of arcuately shaped slots 37 may be formed in the sleeve 32 as described hereinafter. A heater filament 38 is mounted within the cathode sleeve 32. The heater filament 38 includes a heater body portion 40 and a pair of filament legs 42 extending from the body portion 40. The heater filament 38 has an insulating coating thereon, as is known in the art, except for a short section of each of the legs 42, which are welded to a pair of heater straps 44 disposed within the cathode sleeve 32.

Figure 7:
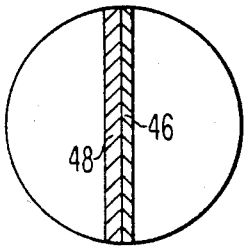
FIG. 7 is an enlarged view of the portion of the cathode sleeve within circle 7 of FIG. 4.
Figure 4:
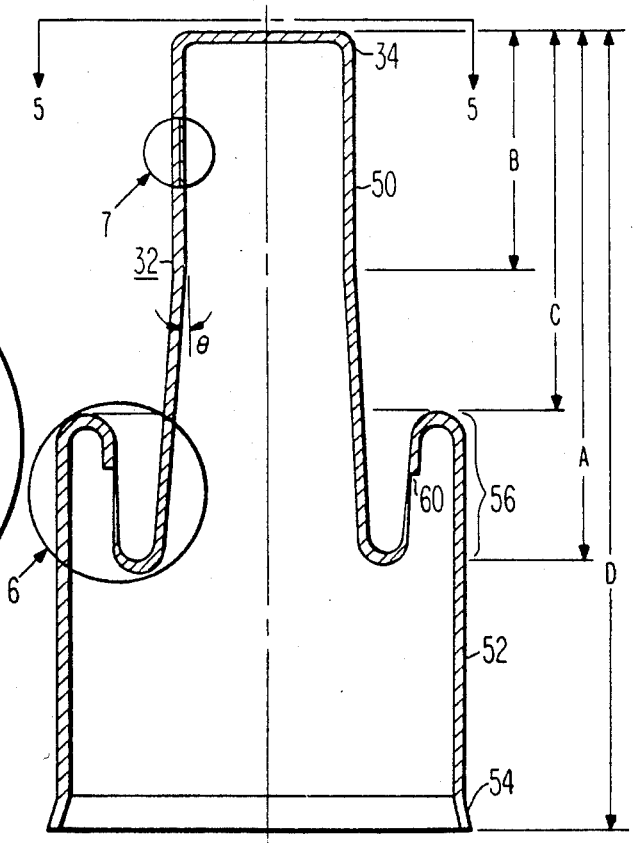
FIG. 4 is an enlarged axial section view of the novel cathode sleeve prior to etching to provide the cathode cap.

The novel tubular cathode sleeve 32 is formed by deep drawing and by reverse drawing, as shown in FIG. 4. The cathode sleeve 32 is identical for each of the three cathode assemblies 30. The cathode sleeve 32 comprises a laminated bimetal member, including a first layer 46 and a second layer 48. The laminated bimetal layers 46 and 48 are shown in enlarged detail in FIGS. 6 and 7. The first layer 46 preferably comprises Nichrome, which has a thermal conductivity of about 0.195 watts/cm/°K. at 700° K. Typically, the first layer 46 has a thickness of about 0.028 mm (1.1 mils). The second layer 48 preferably comprises bright nickel, which has a thermal conductivity of about 0.65 watts/cm/°K. at 700° K. and a thickness of about 0.048 mm (1.9 mils).

The cathode sleeve 32 includes two generally longitudinally extending portions 50 and 52, the latter being of substantially larger diameter than the former. The first portion 50 includes the closed end having the integral cap 34. The first portion 50 has an overall length, A, within the range of about 4.19 to about 4.29 mm. The cap 34 has an outside diameter of about 1.47 to about 1.50 mm and an inside diameter of about 1.32 mm. To facilitate forming, the outside diameter of the first portion 50 is held constant for a distance, B, of about 1.88 to about 1.93 mm at which point it flares outwardly at an angle, $\theta$, of about 4 degrees.

Figure 6:
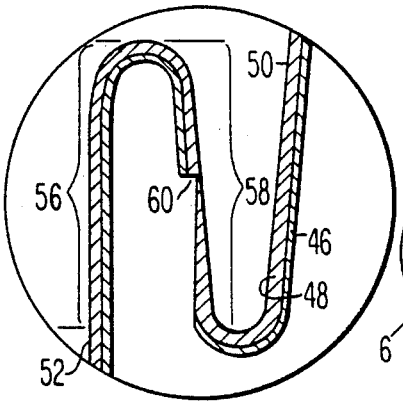
FIG. 6 is an enlarged view of the portion of the cathode sleeve within circle 6 of FIG. 4.

The second portion 52 originates at a distance, C, from the top of the cap 34. The distance C is within the range of about 3.00 to about 3.10 mm. The outside diameter of the second portion 52 is about 3.28 to about 3.33 mm, and the inside diameter is about 3.14 mm. The second portion 52 terminates in a flare 54 surrounding the open end of the cathode sleeve 32 at a distance, D, from the top of the cap 34. The distance D is about 6.35 mm, and the outside diameter of the flare 54 is about 3.40 mm. As shown in FIG. 4, a segment 56 of the second portion 52 coaxially encompasses a section of the first portion 50 of the sleeve 32. A transition region 58, shown in the enlarged view of FIG. 6, is formed by reverse drawing the sleeve 32 first in one direction, then in the opposite direction. The transition region 58 connects the first and second portions 50 and 52, respectively, and has a length of about 1.27 mm. The transition region 58 effectively increases the thermal length of the sleeve without making the overall length of the sleeve physically longer.

Figure 5:
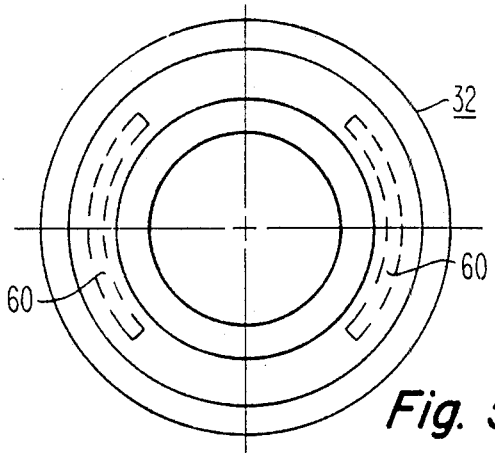
FIG. 5 is a top view of the novel cathode sleeve taken along lines 5—5 of FIG. 4.

In order to further lower the thermal conductivity of the cathode sleeve 32 to concentrate the heat in the first portion 50 and, more particularly, in the end cap 34, the first layer 46 of the sleeve 32 may be pierced at a plurality of locations 60 within the transition region 58. While only two pierced locations 60 are shown in FIG. 5, three or more pierced locations are within the scope of the invention. As shown in FIG. 5, each of the pierced locations (shown in phantom) extends about 90° around the transition region 58. When, for example, the first layer 46 is pierced at three locations, each of the pierced locations extend about 60° around the transition region 58. The arcuately shaped pierced locations 60 have a lateral dimension greater than the longitudinal dimension thereof.

The cathode sleeve 32 is selectively etched in a suitable mixture of acetic and nitric acids to remove the second layer 48 of nickel from all portions of the sleeve except for the cap 34. The etching exposes the Nichrome layer 46 which has lower thermal conductivity than the nickel layer 48 and forms the slots 37 in the pierced locations 60. The reverse draw used to form the transition region 58 increases the effective thermal length of the cathode sleeve 32, while simultaneously reducing the physical length of the sleeve to about 6.35 mm. Reducing the overall cathode sleeve length permits the length of the heater legs 42 to also be shortened. Additionally, since the second portion 52 of the sleeve 32 has a substantially larger diameter than the first portion 50, the heater straps 44 can be located within the second portion 52 of the sleeve 32, thereby minimizing the length of the heater legs 44. In a conventional heater such as that shown in the above-referenced U.S. Pat. No. 3,772,554 to Hughes, about 20 percent of the input heater power is lost by radiation from the long heater legs which must extend beyond the open end of the cathode sleeve to contact the heater straps. The novel sleeve structure conserves heat and lowers the input power required to reach cathode emission temperature by allowing the heater straps to be located within the large diameter second portion 52 of the heater sleeve 32. If the slots 37, shown in FIG. 3, are formed in the transition region of the sleeve 32, additional heat will be conserved since the slots 37 provide heat dams which further reduce thermal conduction along the sleeve 32. By forming the slots 37 in the transition region, which is shielded from the heater legs 42 by the first portion 50 of the sleeve 32, no additional radiation loss from the heater legs 42 occurs.

Figure 8:
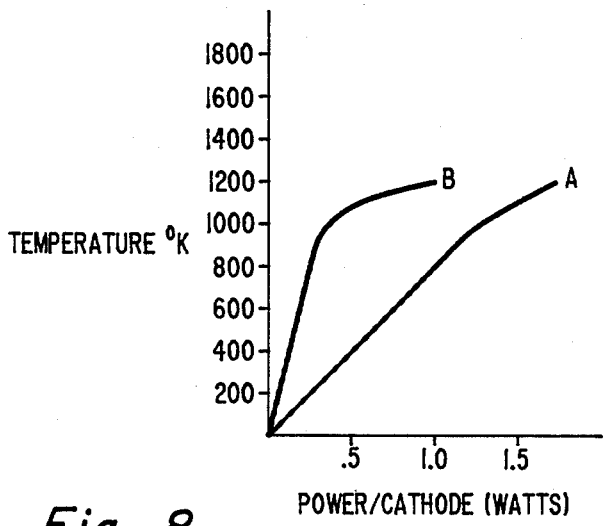
FIG. 8 is a graph of Power Per Cathode versus Temperature for a conventional cathode assembly and for the present novel cathode assembly.

FIG. 8 graphically summarizes the performance of a prior art cathode assembly and a cathode assembly 30 of the present invention by plotting the input power-per-cathode required to obtain a specific temperature. Curve A is for a conventional cathode assembly, such as that disclosed in the Hughes patent, having a typical cathode diameter of 2.16 mm and a length of 8.89 mm. The heater legs of the conventional cathode extend beyond the open end of the cathode sleeve for connecting to the cathode heater straps. The conventional cathode assembly requires an average input power of about 1.5 watts (1.3 to 1.6 watts) to reach an operating temperature of 1130° K.

Curve B was obtained using the cathode assembly 30 of the present invention. The cathode assembly 30 utilizes the novel cathode sleeve 32 having the reverse drawn transition region 58 connecting the small diameter first portion 50 and the larger diameter second portion 52 of the cathode sleeve. The cathode assembly 30 did not have the slots 37 formed therein. The reverse drawn cathode sleeve 32 has a smaller cap diameter than the standard cathode assembly and a long thermal conduction path to decrease power (heat) loss by conduction. The large diameter second portion 52 also allows a heater with shorter heater legs to be disposed within the cathode sleeve 32. The slope of curve B up to about 800° K. indicates that thermal losses for the cathode assembly 30 are less than for a conventional cathode assembly. Above 800° K., curve B changes slope such that the change in temperature ($\Delta T$) with changes in input power ($\Delta P$), or $\Delta T/\Delta P$, decreases, and the cathode assembly 30 is less sensitive to power fluctuations. This is accomplished by attaching the three cathode support members 12 to the ceramic support member 16, which has good thermal radiation characteristics and poor thermal conduction characteristics. Thus, in the high temperature range (i.e., in the vicinity of 1130° K.), the actual change in $\Delta T/\Delta P$ for the cathode assembly 30, represented by curve B, is lower than for the conventional cathode assembly represented by curve A.

What is claimed is:

1. In a cathode-ray tube having an electron gun including a cathode assembly comprising a cathode sleeve having oppositely disposed ends, said cathode sleeve being open at one end and closed at the other end, said closed end including a cap having an electron emitting coating thereon, and a heater filament disposed within said sleeve, said heater filament having a heater body portion with a pair of heater legs extending therefrom, said heater legs being attached to a pair of heater straps, the improvement wherein said cathode sleeve comprising a generally longitudinally extending first portion having a first diameter conforming closely to said heater body portion of said heater filament for reducing the power requirements thereof, and a second generally longitudinally extending portion having a diameter greater than said first diameter, said first portion including said closed end and said cap, said second portion having a segment coaxially encompassing a section of said first portion of said sleeve below said cap, said segment of said second portion being connected to said section of said first portion by transition means formed to provide an effectively extended thermal length, said second portion, said section of said first portion and said transition means being formed of a material having a lower thermal conductivity than that of said cap to minimize heat conduction along said sleeve, and thermal radiation reduction means for minimizing the thermal losses from said heater legs.

2. The tube as in claim 1, wherein transition means includes a reverse drawn transition region.

3. The tube as in claim 2, wherein said transition region includes a plurality of slots formed in said transition region.

4. The tube as in claim 1, wherein said cathode sleeve comprises a laminated bimetal member along less than all of said first portion.

5. In an electron gun including a cathode assembly comprising a cathode sleeve having oppositely disposed ends, said cathode sleeve being open at one end and closed at the other end, said closed end including a cap having an electron emitting coating thereon, a heater filament disposed within said sleeve, said heater filament having a heater body portion with a pair of heater legs extending therefrom, said heater legs being attached to a pair of heater straps, and a cathode eyelet disposed around at least a portion of said cathode sleeve and attached thereto, the improvement wherein said cathode sleeve comprising a laminated bimetal member having a first layer of material and a second layer of material overlying less than all of said first layer, said second layer having a thermal conductivity higher than that of said first layer, said sleeve including a generally longitudinally extending first portion having a first diameter conforming closely to said heater body portion of said heater filament for reducing the power requirement thereof, and a second generally longitudinally extending portion having a diameter greater than said first diameter, said first portion including said closed end and said cap, said cap being formed of said second layer of material having the higher thermal conductivity, said second portion having a segment which coaxially encompasses a section of said first portion of said sleeve below said cap, said segment of said second portion being connected to said section of said first portion by a reverse drawn transition region, said transition region providing an effectively extended thermal length, greater than the overall length of said sleeve, said second portion, said section of said first portion and said transition region being formed of said first layer of material to minimize heat conduction along said sleeve, said transition region having a plurality of slots formed therein, and said heater legs terminating within said second portion of said cathode sleeve having said greater diameter, whereby said pair of heater straps may be accommodated in said greater diameter second portion to minimize thermal losses from said heater legs.

* * * * *